US008292730B2

(12) United States Patent
Bennett

(10) Patent No.: US 8,292,730 B2
(45) Date of Patent: Oct. 23, 2012

(54) GAMING SYSTEM AND A METHOD OF GAMING

(75) Inventor: Nicholas Luke Bennett, Manley Vale (AU)

(73) Assignee: Aristocrat Technologies Australia Pty Limited, North Ryde, NSW (AU)

( * ) Notice: Subject to any disclaimer, the term of this patent is extended or adjusted under 35 U.S.C. 154(b) by 671 days.

(21) Appl. No.: 12/190,343

(22) Filed: Aug. 12, 2008

(65) Prior Publication Data

US 2009/0181762 A1 Jul. 16, 2009

(30) Foreign Application Priority Data

Aug. 13, 2007 (AU) ..... 2007904336

(51) Int. Cl.
*A63F 9/24* (2006.01)

(52) U.S. Cl. ..... 463/25; 463/20

(58) Field of Classification Search ..... 463/20, 463/25

See application file for complete search history.

(56) References Cited

U.S. PATENT DOCUMENTS

| | | | | |
|---|---|---|---|---|
| 3,655,189 | A | 4/1972 | Alexander | |
| 3,790,170 | A | 2/1974 | Alexander | |
| 6,328,649 | B1 * | 12/2001 | Randall et al. | 463/20 |
| 6,506,118 | B1 * | 1/2003 | Baerlocher et al. | 463/25 |
| 6,596,015 | B1 | 7/2003 | Pitt et al. | |
| 6,719,632 | B2 * | 4/2004 | Palmer et al. | 463/25 |
| 6,722,983 | B2 * | 4/2004 | Kaminkow et al. | 463/26 |
| 6,761,632 | B2 * | 7/2004 | Bansemer et al. | 463/16 |
| 6,793,579 | B2 * | 9/2004 | Baerlocher et al. | 463/25 |
| 7,731,579 | B2 * | 6/2010 | Gomez et al. | 463/16 |
| 2002/0013170 | A1 | 1/2002 | Miller et al. | |
| 2002/0025846 | A1 | 2/2002 | Bennett | |
| 2003/0078093 | A1 | 4/2003 | Simms et al. | |
| 2003/0107171 | A1 | 6/2003 | Armstrong | |
| 2003/0114218 | A1 | 6/2003 | McClintic | |
| 2003/0119586 | A1 | 6/2003 | Crumby | |
| 2004/0082378 | A1 | 4/2004 | Peterson et al. | |
| 2004/0235552 | A1 | 11/2004 | Gauselmann | |
| 2005/0280213 | A1 | 12/2005 | Kenney et al. | |
| 2006/0052151 | A1 * | 3/2006 | Gomez | 463/16 |
| 2006/0281511 | A1 | 12/2006 | Holm et al. | |
| 2007/0060297 | A1 | 3/2007 | Hein et al. | |

FOREIGN PATENT DOCUMENTS

| | | |
|---|---|---|
| DE | 19601768 | 7/1997 |
| EP | 1310924 | 5/2003 |
| GB | 287788 | 3/1928 |
| GB | 1349339 | 4/1974 |
| WO | WO03082415 | 10/2003 |
| WO | WO2004060512 | 7/2004 |
| WO | WO2005105250 | 11/2005 |
| WO | WO2006033900 | 3/2006 |

* cited by examiner

*Primary Examiner* — Masud Ahmed
(74) *Attorney, Agent, or Firm* — Hanley, Flight & Zimmerman, LLC

(57) ABSTRACT

A method of gaming comprising: determining at least one game outcome; determining a total award from the at least one game outcome; modifying the total award based on a size of the total award to obtain a modified total award; and awarding the modified total award.

32 Claims, 6 Drawing Sheets

GAMING SYSTEM AND A METHOD OF GAMING

CROSS-REFERENCE TO RELATED APPLICATIONS

This application is related to and claims the benefit of priority to Australian Provisional Patent Serial No. 2007904336, entitled "A Gaming System and a Method of Gaming", filed on Aug. 13, 2007, the content of which is herein incorporated by reference in its entirety.

FIELD

The present invention relates to a gaming system, a method of gaming, a game controller and computer program code.

BACKGROUND TO THE INVENTION

It is known to provide a gaming system which includes a game controller arranged to randomly display several symbols from a predetermined set of symbols and to determine a game outcome such as a game win based on the displayed symbols. Such gaming systems may commonly be implemented as a stepper machine provided with reels with each reel carrying several symbols of the set, or a video machine wherein selected symbols are displayed on virtual reels on a video display.

While such gaming systems provide users with enjoyment, an unmet need exists is for alternative gaming systems in order to maintain or increase player enjoyment.

SUMMARY OF THE INVENTION

In a first aspect, the invention provides a method of gaming comprising:

determining at least one game outcome;

determining a total award from the at least one game outcome;

modifying the total award based on a size of the total award to obtain a modified total award; and awarding the modified total award.

In an embodiment, the method includes modifying the total award based on a modification rule adapted to increase the volatility of the modified total award.

In an embodiment, the method includes modifying the total award based on a modification rule adapted to decrease the volatility of the modified total award.

In an embodiment, the total award is modified by multiplication.

In an embodiment the total award is modified by awarding a bonus prize as the modified total award.

In an embodiment, the method includes determining a plurality of game outcomes such that the total award is determined from the plurality of game outcome.

In an embodiment, the method includes modifying the total award by:

awarding an entitlement to at least one further game outcome, determining a further total award from the at least one further game outcome;

modifying the further total award based on a size of the total award to obtain a further modified total award; and awarding the further modified total award.

In an embodiment, the method includes setting a plurality of ranges of total award sizes, assigning different modifications to each range, and modifying the total award in accordance with the modification assigned to the range within which the total award falls.

In an embodiment, the method includes determining that a player has an entitlement to the at least one game outcome prior to determining the at least one game outcome.

In an embodiment, the method includes determining the game outcomes in a sequence.

In a second aspect, the invention provides a game controller for a gaming system, the game controller arranged to:

determine at least one game outcome;

determine a total award from the at least one game outcome;

modify the total award based on a size of the total award to obtain a modified total award; and award the modified total.

In an embodiment, the game controller includes an outcome determiner arranged to determine each game outcome.

In an embodiment the game controller includes a total award module arrange to determine the total award from the at least one game outcome.

In an embodiment, the game controller includes an award modification module arrange to modify the total award based on a size of the total award to obtain a modified total award.

In an embodiment, the award modification module is arranged to modify the total award based on a modification rule adapted to increase the volatility of the modified total award.

In an embodiment, the award modification module is arranged to modify the total award based on a modification rule adapted to decrease the volatility of the modified total award.

In an embodiment the total award is modified by multiplication.

In an embodiment, the total award is modified by awarding a bonus prize as the modified total award.

In an embodiment, the game controller is arranged to determine a plurality of game outcomes such that the total award is determined from the plurality of game outcome.

In an embodiment, the game controller is arranged to modify the total award by:

awarding an entitlement to at least one further game outcome, determining a further total award from the at least one further game outcome;

modifying the further total award based on a size of the total award to obtain a further modified total award; and awarding the further modified total award.

In an embodiment, the award modification module is arranged modify the total award in accordance with a modification assigned to the range within which the total award falls, different modifications being assigned to a plurality of ranges of total award amounts.

In an embodiment, the game controller is arranged to determine that a player has an entitlement to the at least one game outcome prior to determining the at least one game outcome.

In an embodiment, the game controller is implemented, at least in part, by a processor executing program code stored in a memory.

In a third aspect, the invention provides a gaming system comprising:

a player interface comprising a display for displaying game outcomes to a player; and a game controller arranged to:

determine at least one game outcome;

control the display to display the at least one game outcome;

determine a total award from the at least one game outcome;

modify the total award based on a size of the total award to obtain a modified total award; and award the modified total award to the player.

In an embodiment, the game controller includes an outcome determiner arranged to determine each game outcome.

In an embodiment, the game controller includes a total award module arrange to determine the total award from the at least one game outcome.

In an embodiment, the game controller includes an award modification module arrange to modify the total award based on a size of the total award to obtain a modified total award.

In an embodiment, the award modification module is arranged to modify the total award based on a modification rule adapted to increase the volatility of the modified total award.

In an embodiment, the award modification module is arranged to modify the total award based on a modification rule adapted to decrease the volatility of the modified total award.

In an embodiment, the total award is modified by multiplication.

In an embodiment, the total award is modified by awarding a bonus prize as the modified total award.

In an embodiment, the game controller is arranged to determine a plurality of game outcomes such that the total award is determined from the plurality of game outcome.

In an embodiment, the game controller is arranged to modify the total award by:

awarding an entitlement to at least one further game outcome, determining a further total award from the at least one further game outcome;

modifying the further total award based on a size of the total award to obtain a further modified total award; and awarding the further modified total award.

In an embodiment, the award modification module is arranged modify the total award in accordance with a modification assigned to the range within which the total award falls, different modifications being assigned to a plurality of ranges of total award amounts.

In an embodiment, the gaming system is arranged to determine that a player has an entitlement to the at least one game outcome prior to determining the at least one game outcome.

In an embodiment, the game controller is implemented, at least in part, by a processor executing program code stored in a memory.

In a fourth aspect, the invention provides computer program code which when executed by a processor implements the method of the first aspect.

In a fifth aspect, the invention provides a computer readable medium comprising the above program code.

In a sixth aspect, the invention provides a data signal comprising the above program code.

In a seventh aspect, the invention extends to transmitting the above program code.

BRIEF DESCRIPTION OF THE DRAWINGS

Certain embodiments of the invention will now be described in relation to the following drawings in which.

Figure 1:
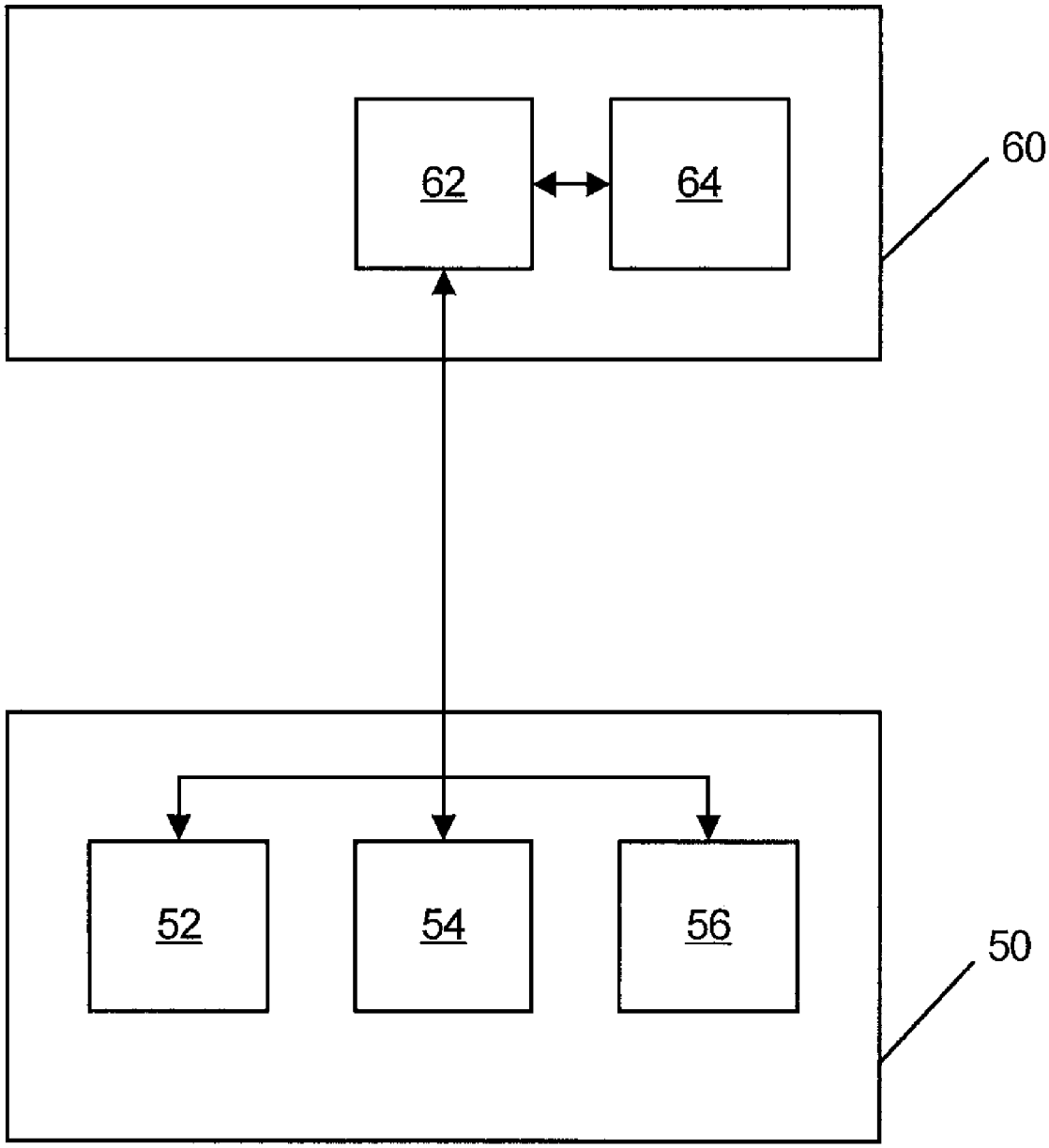
FIG. 1 is a block diagram of the core components of a gaming system.

The embodiments shown in the drawings are presented for purposes of illustration only. It should be understood, however, that the present invention is not limited to the arrangements and instrumentality shown in the attached drawings

DETAILED DESCRIPTION

Certain embodiments provide a gaming system where a player plays, at least one game, and, in an advantageous embodiment a sequence of games. A total award is determined for the at least one game or sequence of games. A modified total award is then determined based on the size of the total award. The total award may be modified, for example, by assigning different modifications to different ranges of total award sizes. The gaming system may be provided in a number of different forms.

In a first form, a stand alone gaming machine is provided wherein all or most components required for implementing the game are present in a player operable gaming machine.

In a second form, a distributed architecture is provided wherein some of the components required for implementing the game are present in a player operable gaming machine and some of the components required for implementing the game are located remotely relative to the gaming machine. For example, a "thick client" architecture may be used wherein part of the game is executed on a player operable gaming machine and part of the game is executed remotely, such as by a gaming server; or a "thin client" architecture may be used wherein most of the game is executed remotely such as by a gaming server and a player operable gaming machine is used only to display audible and/or visible gaming information to the player and receive gaming inputs from the player.

However, it will be understood that other arrangements are envisaged. For example, an architecture may be provided wherein a gaming machine is networked to a gaming server and the respective functions of the gaming machine and the gaming server are selectively modifiable. For example, the gaming system may operate in stand alone gaming machine mode, "thick client" mode or "thin client" mode depending on the game being played, operating conditions, and so on. Other variations will be apparent to persons skilled in the art.

Irrespective of the form, the gaming system has several core components. At the broadest level, the core components are a player interface 50 and a game controller 60 as illustrated in FIG. 1. The player interface is arranged to enable manual interaction between a player and the gaming system and for this purpose includes the input/output components required for the player to enter instructions and play the game.

Components of the player interface may vary from embodiment to embodiment but will typically include a credit mechanism 52 to enable a player to input credits and receive payouts, one or more displays 54 and a game play mechanism 56 that enables a player to input game play instructions.

The game controller 60 is in data communication with the player interface and typically includes a processor 62 that processes the game play instructions in accordance with game play rules and outputs game play outcomes to the display. Typically, the game play instructions are stored as program code in a memory 64 but can also be hardwired. Herein the term "processor" is used to refer generically to any device that can process game play instructions in accordance with game play rules and may include: a microprocessor, microcontroller, programmable logic device or other computational device, a general purpose computer (e.g. a PC) or a server.

Figure 2:
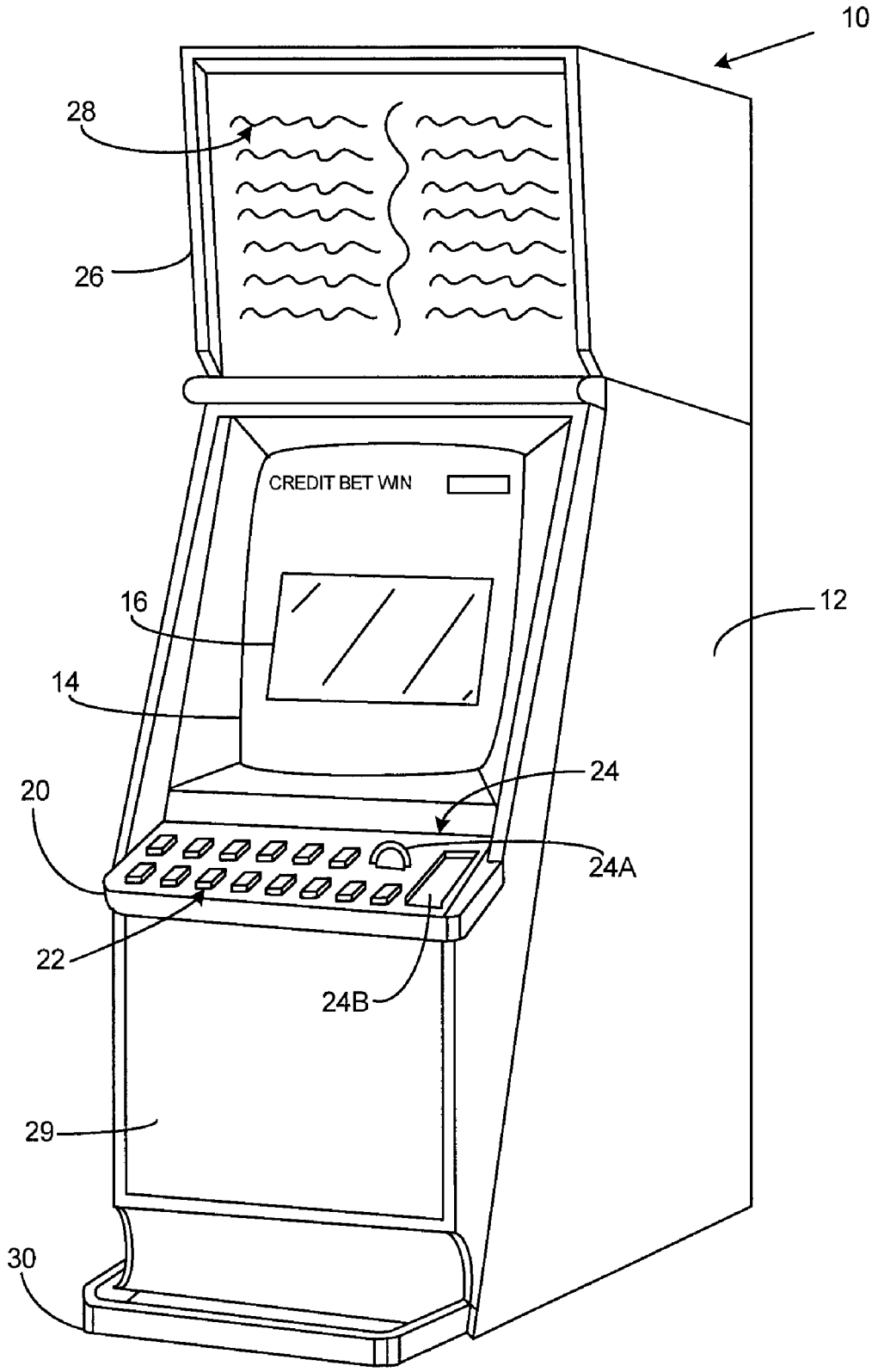
FIG. 2 is a perspective view of a gaming machine.

A gaming system in the form of a stand alone gaming machine 10 is illustrated in FIG. 2. The gaming machine 10 includes a console 12 having a display 14 on which is displayed representations of a game 16 that can be played by a player. A mid-trim 20 of the gaming machine 10 houses a bank of buttons 22 for enabling a player to interact with the gaming machine, in particular during game play. The mid-trim 20 also houses a credit input mechanism 24 which in this example includes a coin input chute 24A and a bill collector 24B. Other credit input mechanisms may also be employed, for example, a card reader for reading a smart card, debit card or credit card. A player marketing module may be provided having a reading device may also be provided for the purpose of reading a player tracking device, for example as part of a loyalty program. The player tracking device may be in the form of a card, flash drive or any other portable storage medium capable of being read by the reading device.

A top box 26 may carry artwork 28, including for example pay tables and details of bonus awards and other information or images relating to the game. Further artwork and/or information may be provided on a front panel 29 of the console 12. A coin tray 30 is mounted beneath the front panel 29 for dispensing cash payouts from the gaming machine 10.

The display 14 shown in FIG. 2 is in the form of a video display unit, particularly a cathode ray tube screen device. Alternatively, the display 14 may be a liquid crystal display, plasma screen, any other suitable video display unit, or the visible portion of an electromechanical device. The top box 26 may also include a display, for example a video display unit, which may be of the same type as the display 14, or of a different type.

Figure 3:
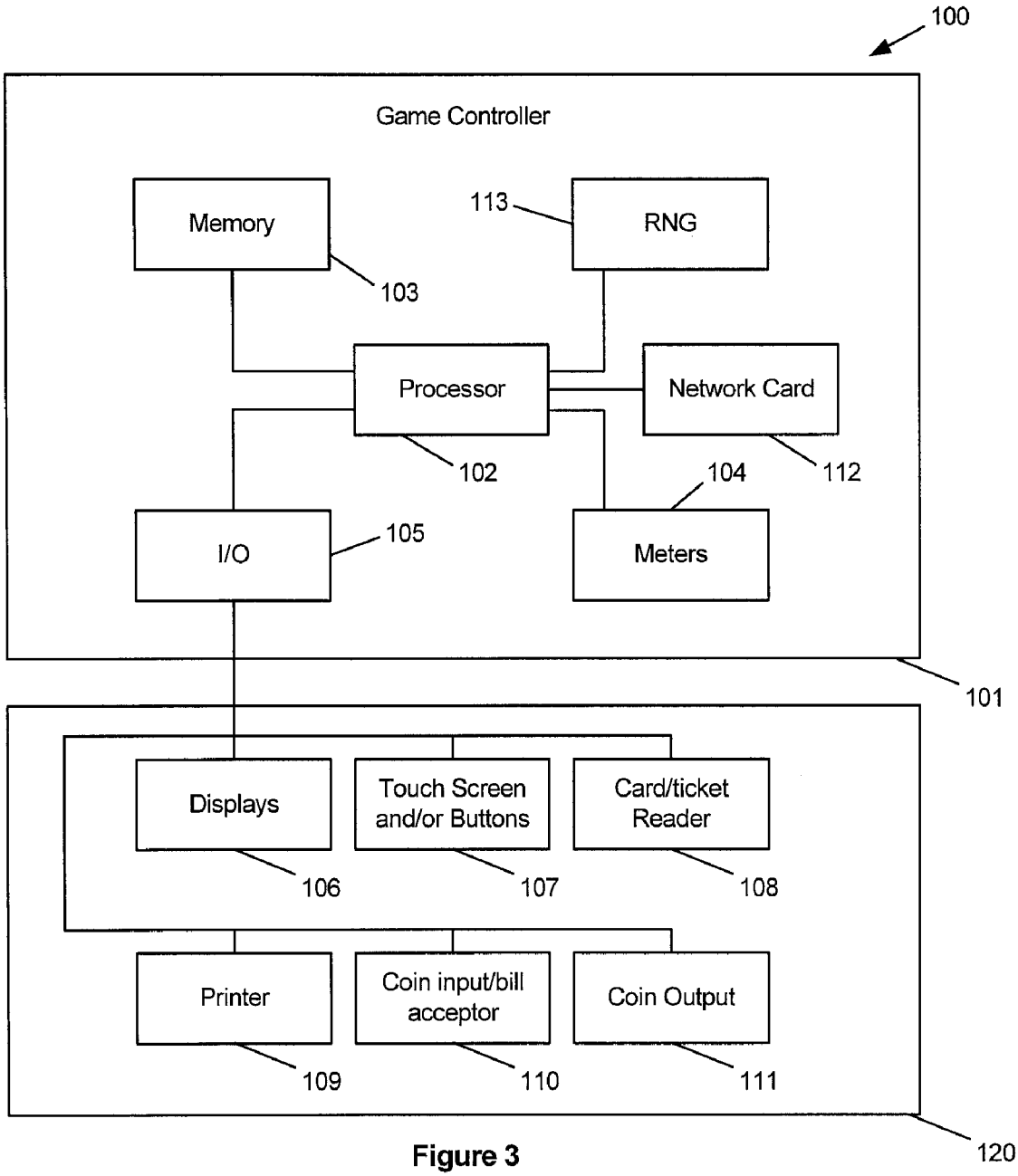
FIG. 3 is a block diagram of the functional components of a gaming machine.

FIG. 3 shows a block diagram of operative components of a typical gaming machine which may be the same as or different to the gaming machine of FIG. 2.

The gaming machine 100 includes a game controller 101 having a processor 102. Instructions and data to control operation of the processor 102 are stored in a memory 103, which is in data communication with the processor 102. Typically, the gaming machine 100 will include both volatile and non-volatile memory and more than one of each type of memory, with such memories being collectively represented by the memory 103.

The gaming machine has hardware meters 104 for purposes including ensuring regulatory compliance and monitoring player credit, an input/output (I/O) interface 105 for communicating with peripheral devices of the gaming machine 100. The input/output interface 105 and/or the peripheral devices may be intelligent devices with their own memory for storing associated instructions and data for use with the input/output interface or the peripheral devices. A random number generator module 113 generates random numbers for use by the processor 102. Persons skilled in the art will appreciate that the reference to random numbers includes pseudo-random numbers.

In the example shown in FIG. 3, a player interface 120 includes peripheral devices that communicate with the game controller 101 has one or more displays 106, a touch screen and/or buttons 107, a card and/or ticket reader 108, a printer 109, a bill acceptor and/or coin input mechanism 110 and a coin output mechanism 111. Additional hardware may be included as part of the gaming machine 100, or hardware may be omitted for a specific implementation.

In addition, the gaming machine 100 may include a communications interface, for example a network card 112. The network card may, for example, send status information, accounting information or other information to a central controller, server or database and receive data or commands from the central controller, server or database.

Figure 4:
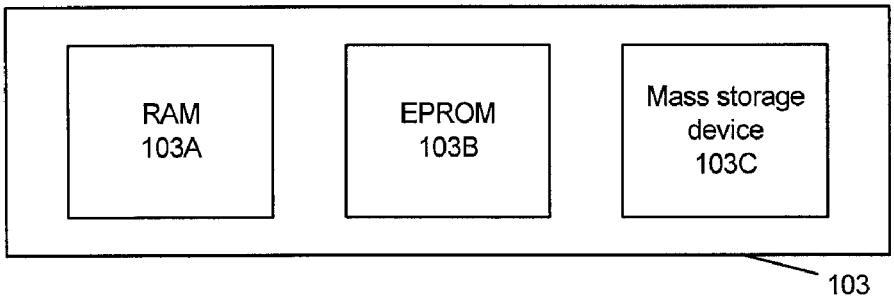
FIG. 4 is a block diagram representing the structure of a memory.

FIG. 4 shows a block diagram of the main components of an exemplary memory 103. The memory 103 includes RAM 103A, EPROM 103B and a mass storage device 103C. The RAM 103A typically temporarily holds program files for execution by the processor 102 and related data. The EPROM 103B may be a boot ROM device and/or may contain some system or game related code. The mass storage device 103C is typically used to store game programs, the integrity of which may be verified and/or authenticated by the processor 102 using protected code from the EPROM 103B or elsewhere.

It is also possible for the operative components of the gaming machine 100 to be distributed, for example input/output devices 106,107,108,109,110,111 to be provided remotely from the game controller 101.

Figure 5:
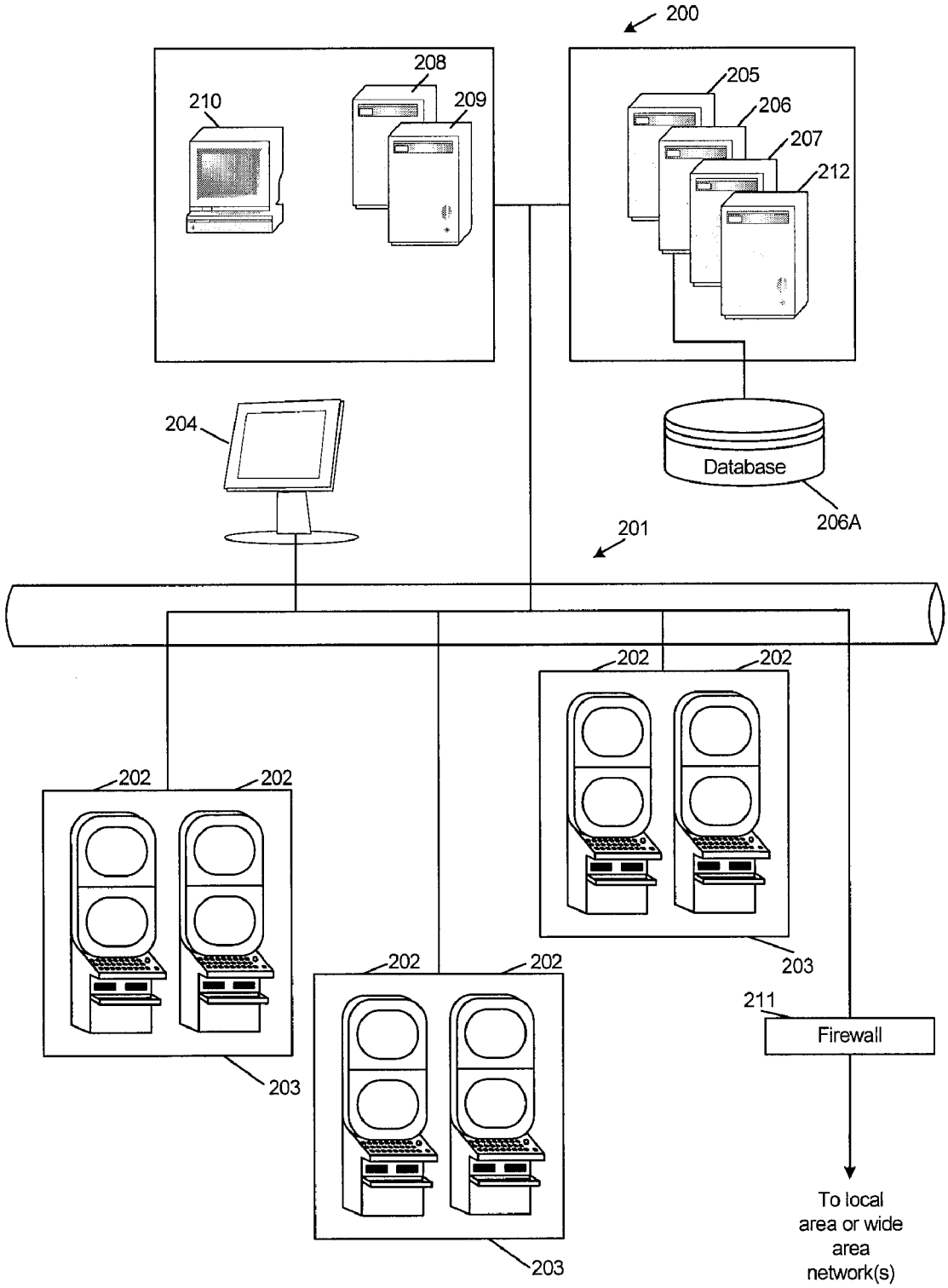
FIG. 5 is a diagram schematic of a networked gaming system.

FIG. 5 shows a gaming system 200 in accordance with an alternative embodiment. The gaming system 200 includes a network 201, which for example may be an Ethernet network. Gaming machines 202, shown arranged in three banks 203 of two gaming machines 202 in FIG. 5, are connected to the network 201. The gaming machines 202 provide a player operable interface and may be the same as the gaming machines 10,100 shown in FIGS. 2 and 3, or may have simplified functionality depending on the requirements for implementing game play. While banks 203 of two gaming machines are illustrated in FIG. 5, banks of one, three or more gaming machines are also envisaged.

One or more displays 204 may also be connected to the network 201. The displays 204 may, for example, be associated with one or more banks 203 of gaming machines. The displays 204 may be used to display representations associated with game play on the gaming machines 202, and/or used to display other representations, for example promotional or informational material.

In a thick client embodiment, game server 205 implements part of the game played by a player using a gaming machine 202 and the gaming machine 202 implements part of the game. With this embodiment, as both the game server and the gaming device implement part of the game, they collectively provide a game controller. A database management server 206 may manage storage of game programs and associated data for downloading or access by the gaming devices 202 in a database 206A. Typically, if the gaming system enables players to participate in a Jackpot game, a Jackpot server 207 will be provided to carry out the accounting in respect of the Jackpot game. A loyalty program server 212 may also be provided.

In a thin client embodiment game server 205 implements most or all of the game played by a player using a gaming machine 202 and the gaming machine 202 essentially provides only the player interface. With this embodiment, the game server 205 provides the game controller. The gaming machine will receive player instructions, pass these to the game server which will process them and return game play outcomes to the gaming machine for display. In a thin client embodiment, the gaming machines could be computer terminals, e.g. PCs running software that provides a player interface operable using standard computer input and output components.

Servers are also typically provided to assist in the administration of the gaming network 200, including for example a gaming floor management server 208, and a licensing server 209 to monitor the use of licenses relating to particular games. An administrator terminal 210 is provided to allow an administrator to run the network 201 and the devices connected to the network.

The gaming network 200 may communicate with other gaming systems, other local networks, for example a corporate network, and/or a wide area network such as the Internet, for example through a firewall 211.

Persons skilled in the art will appreciate that in accordance with known techniques, functionality at the server side of the network may be distributed over a plurality of different computers. For example, elements may be run as a single "engine" on one server or a separate server may be provided. For example, the game server 205 could run a random generator engine. Alternatively, a separate random number generator server could be provided. Further, persons skilled in the art will appreciate that a plurality of games servers could be provided to run different games or a single game server may run a plurality of different games based on the terminals.

Certain embodiments may be implemented in relation to a spinning reel type game. Gaming systems for implementing games that involve a display of spinning reels as part of the display of the outcome of a game have either a video display or a mechanical display, these later machines most usually being "stepper" machines which have a separate motor for each reel. However, persons skilled in the art will appreciate that the invention can be implemented in respect if other forms of games, including; card games; ball draw games (e.g. bingo or keno); dice games; and pin and ball games.

In some implementations the game controllers of such gaming machines select symbols by employing a stop determining function that randomly determines the stop position for each reel. For example, if there are five reels, each having twenty symbols, the stop determining function might determine that the stop positions are positions: 3, 13, 7, 9 and 17. The spinning of the reels is then controlled so that each symbol comes to a stop in the same row, typically a predetermined row in a "window" visible to the player on the display that which corresponds to a player playing a single win line. When a reel stops, the symbols will be in one of a plurality of possible symbol positions for that reel relative to the stop position.

Spinning reel type games typically allow a player to select bow many win lines of a plurality of win lines they will play in each game—i.e. a minimum of one win line up to the maximum number of win lines allowed by the game. Persons, skilled in the art, will appreciate that in other embodiments, the player may select a number of reels to play, for example. Each win line is formed by a set of symbol positions consisting of one symbol position from each reel. That is, a predetermined symbol position of each reel is assigned to a win line. The symbol positions that constitute each of the win lines are usually advertised to the player by markings on the display or diagrams showing the symbol positions that correspond to each win line. A game outcome is determined based on the symbols on the win lines and a prize table that specifies awards.

Figure 6:
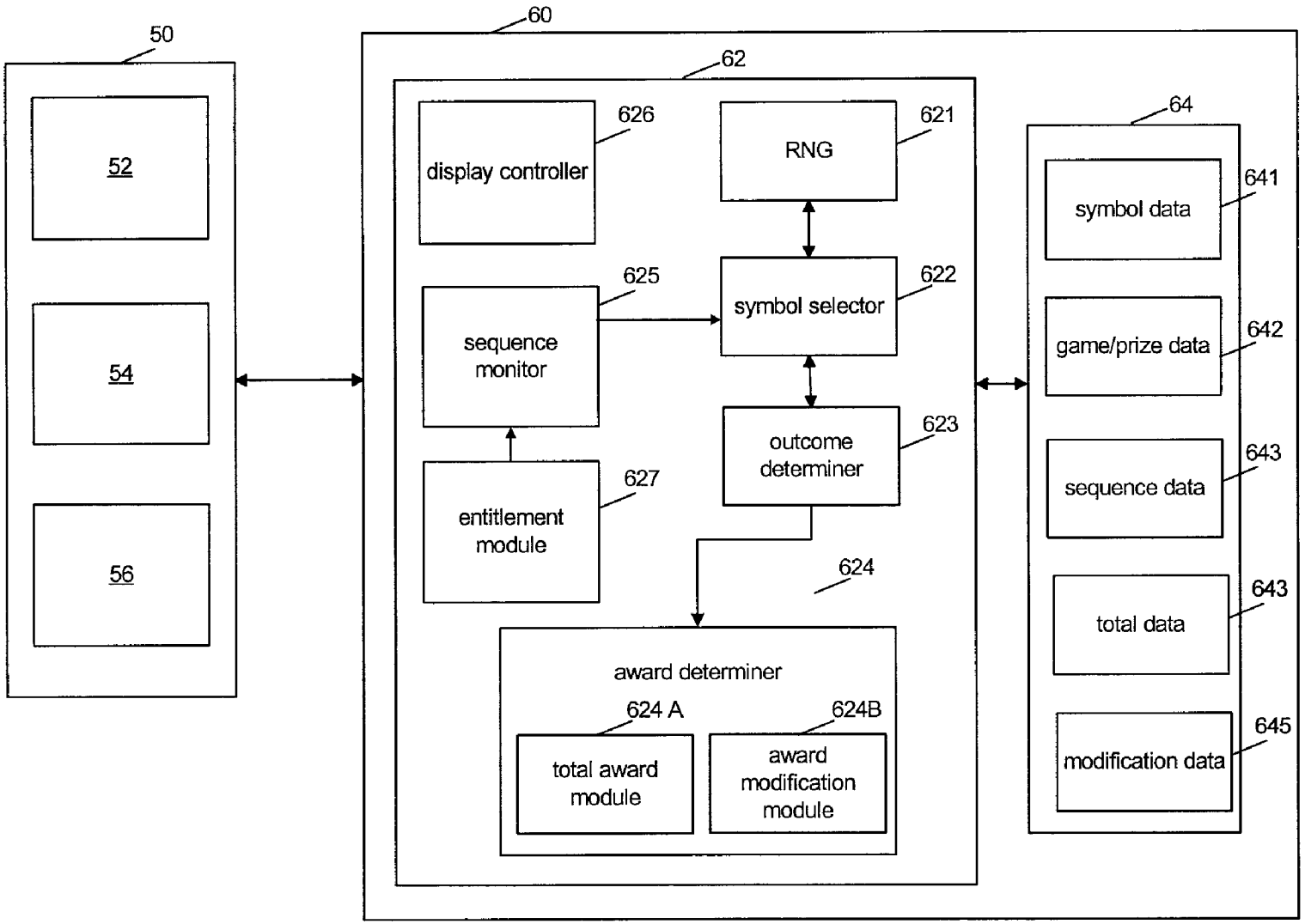
FIG. 6 is a further block diagram of the gaming system.
Figure 7:
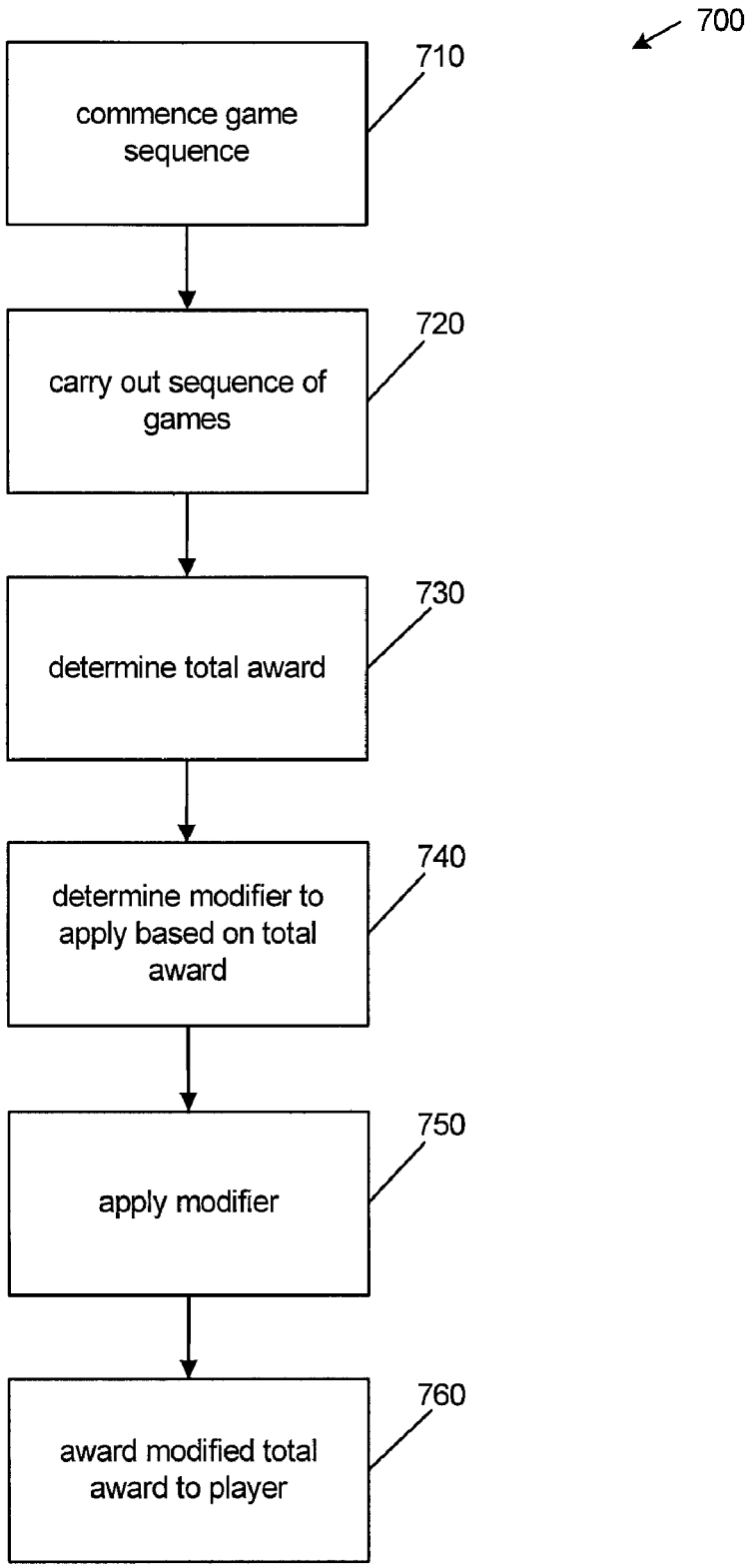
FIG. 7 is a flowchart of an embodiment.

The game controller 60 of the embodiment is shown in more detail in FIG. 6. It will apparent that the processor 62 implements a number of modules based on program code stored in memory 64, namely random number generator module 621, symbol selector module 622, outcome determiner module 623, award determiner module 624, sequence monitoring module 625, entitlement module 627 and display controller module 626 based on data stored in memory 64. Persons skilled in the art will appreciate that not all modules need be implemented by processor 62. For example, the random number generator module 621 could be implemented by a separate circuit or by a random number generator server.

In the embodiment, the entitlement module 627 determines when a player is entitled to a sequence of games. In other embodiments a player may be entitled to a single game. Entitlement can be in accordance with techniques known in the art. For example:

a triggering event such as a particular symbol pattern occurring in a base game;

a special bet being placed such as an ante-bet; or by a triggering event received from a system such as a jackpot system, a loyalty system or the like.

When an entitlement is established, the entitlement module 627 instructs the sequence monitor 625 to initiate a sequence of games based on a number of games specified in sequence data 643. The sequence monitor 625 is arranged to keep track of the sequence to ensure that all games of the sequence are carried out accordingly after each game in the sequence, the sequence monitor 625 updates the sequence data 643 to indicate how many games remain in the sequence.

During each game of a sequence, the symbol selector 622 selects the symbols to appear based on symbol data 641 which specifies the available symbols. The symbols are selected by the symbol selector 622 using a random number obtained from the random number generator 621. The outcome determiner module 623 determines the game outcomes and their associated prizes based on the number of win lines the player is playing and the symbol combinations. Persons skilled in the art will also appreciate that the game outcomes and their associated prizes are displayed on the display 54 or under control of the display controller 626.

An award determiner 624 is employed to keep track of the total award and subsequently to modify that award based on modification data 645. The total is maintained as total data 644 in memory 64. Thus, after each game the total award module 624*a* of the award determiner 624 updates the total data 644 to reflect the current total. The sequence monitor 625 monitors for completion of the sequence and, at the conclusion of the sequence, instructs the award determiner 624 to modify the accumulated total. The award modification module 624*b* applies modification rules based on modification data 645 in order to produce a modified total award. A modified total award is displayed to the player on display 54 under control of the display controller 626.

Persons skilled in the art will appreciate that a sequence of games can be a sequence of free games; a sequence of repeat win games or a sequence of games in a second screen feature, etc.

Persons skilled in the art will appreciate that modification rules can vary from embodiment to embodiment. In all embodiments of the invention, the modifications depend on the size of the award total. The modification can be to multiply the total award, to give a bonus prize, to award another sequence of free games etc.

The modification can be arranged to increase the volatility of a game or to decrease the volatility of a game. The specific nature of the modifications are determined depending on the specific implementation.

The method 700 of an embodiment of the invention is summarised in FIG. 700. At step 710 it is determined game sequence should commence. The game controller 60 then carries out a sequence of games 720, determines the total award 730, determines the modifier to apply based on the total award, applies the modifier 750 and awards the modified total award to the player 760.

Persons skilled in the art will also appreciate that the method of the embodiment could be embodied in program code. The program code could be supplied in a number of ways, for example on a computer readable medium, such as a disc or a memory (for example, that could replace part of memory 103) or as a data signal (for example, by downloading it from a server).

EXAMPLES

Example 1

Increasing the Volatility of a Game

A player is playing a game and triggers a series of 10 free games.

At the conclusion of the free games, the total free game win is modified according to the following rules:

If the total free game win is between 50 and 100, the total win is multiplied by 5;

If the total free game win is between 101 and 500, the total win is multiplied by 10; and If the total free game win is greater than 500, the player is given a bonus of 10000 credits.

Example 2

Decreasing Volatility of a Game

Example 2 operates the same as Example 1, however, the modification rules are:

If the total free game win is between 50 and 100, multiply the win by 10;

If the total free game win is between 101 and 500, multiply the win by 5; and

If the total free game win is greater than 500 award a bonus of 5 free games.

In the claims which follow and in the preceding description of the invention, except where the context indicates otherwise due to express language or necessary implication, the word "comprise" or variations such as "comprises" or "comprising" is used in an inclusive sense, i.e. to specify the presence of the stated features but not to preclude the presence or addition of further features in various embodiments of the invention.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

Several embodiments are described above with reference to the drawings. These drawings illustrate certain details of specific embodiments that implement the systems and methods and programs of the present invention. However, describing the invention with drawings should not be construed as imposing on the invention any limitations associated with features shown in the drawings. The present invention contemplates methods, systems and program products on any electronic device and/or machine-readable media suitable for accomplishing its operations. As noted above, certain embodiments of the present invention may be implemented using an existing computer processor and/or by a special purpose computer processor incorporated for this or another purpose or by a hardwired system, for example.

As noted above, embodiments within the scope of the present invention include program products comprising machine-readable media for carrying or having machine-executable instructions or data structures stored thereon. Such machine-readable media can be any available media that can be accessed by a general purpose or special purpose computer or other machine with a processor. By way of example, such machine-readable media may comprise RAM, ROM, PROM, EPROM, EEPROM, Flash, CD-ROM or other optical disk storage, magnetic disk storage or other magnetic storage devices, or any other medium which can be used to carry or store desired program code in the form of machine-executable instructions or data structures and which can be accessed by a general purpose or special purpose computer or other machine with a processor. When information is transferred or provided over a network or another communications connection (either hardwired, wireless, or a combination of hardwired or wireless) to a machine, the machine properly views the connection as a machine-readable medium. Thus, any such a connection is properly termed a machine-readable medium. Combinations of the above are also included within the scope of machine-readable media. Machine-executable instructions comprise, for example, instructions and data which cause a general purpose computer, special purpose computer, or special purpose processing machines to perform a certain function or group of functions.

Certain embodiments of the invention are described in the general context of method steps which may be implemented in one embodiment by a program product including machine-executable instructions, such as program code, for example in the form of program modules executed by machines in networked environments. Generally, program modules include routines, programs, objects, components, data structures, etc., that perform particular tasks or implement particular abstract data types. Machine-executable instructions, associated data structures, and program modules represent examples of program code for executing steps of the methods disclosed herein. The particular sequence of such executable instructions or associated data structures represents examples of corresponding acts for implementing the functions described in such steps.

The invention claimed is:

1. A method of gaming, wherein a plurality of games is provided for play on a gaming machine, the method comprising:

determining, using a processor, at least one game outcome for each of the plurality of games, the at least one game outcome being associated with a total award;

determining, using a processor, a magnitude of the total award associated with the at least one game outcome;

modifying, using a processor, the total award after play of each game based on the magnitude of the total award to obtain a modified total award, wherein the modified total award is modified by selecting one of a plurality of predefined multipliers to the total award, the multiplier to be applied selected based on the magnitude of the total award; and awarding the modified total award, wherein modifying further comprises setting a plurality of ranges of total award sizes, assigning different modifications to each range, and modifying the total award in accordance with the modification assigned to the range within which the total award falls.

2. A method as claimed in claim 1, including modifying the total award based on a modification rule adapted to increase the volatility of the modified total award.

3. A method as claimed in claim 1, including modifying the total award based on a modification rule adapted to decrease the volatility of the modified total award.

4. A method as claimed in claim 1 wherein the total award is modified by multiplication.

5. A method as claimed in claim 1 wherein the total award is modified by awarding a bonus prize as the modified total award.

6. A method as claimed in claim 1 comprising determining a plurality of game outcomes such that the total award is determined from the plurality of game outcome.

7. A method as claimed in claim 1 including modifying the total award by:

awarding an entitlement to at least one further game outcome, determining a further total award from the at least one further game outcome;

modifying the further total award based on a size of the total award to obtain a further modified total award; and awarding the further modified total award.

8. A method as claimed in claim 1 comprising determining that a player has an entitlement to the at least one game outcome prior to determining the at least one game outcome.

9. A method as claimed in claim 1 comprising determining the game outcomes in a sequence.

10. A game controller for a gaming system, the game controller arranged to:

determine at least one game outcome for each of a plurality of games, the at least one game outcome being associated with a total award;

determine a magnitude of the total award associated with the at least one game outcome;

modify the total award after play of each game based on the magnitude of the total award to obtain a modified total award, wherein the modified total award is modified by selecting one of a plurality of predefined multipliers to the total award, the multiplier to be applied selected based on the magnitude of the total award; and award the modified total, wherein the game controller comprises an award modification module arranged to modify the total award based on the magnitude of the total award to obtain a modified total award, and wherein the award modification module is arranged to modify the total award in accordance with a modification assigned to the range within which the total award falls, different modifications being to assigned to a plurality of ranges of total award amounts.

11. A game controller as claimed in claim 10 comprising an outcome determiner arranged to determine each game outcome.

12. A game controller as claimed in claim 10 comprising a total award module arrange to determine the total award from the at least one game outcome.

13. A game controller as claimed in claim 1, wherein the award modification module is arranged to modify the total award based on a modification rule adapted to increase the volatility of the modified total award.

14. A game controller as claimed in claim 1, wherein the award modification module is arranged to modify the total award based on a modification rule adapted to decrease the volatility of the modified total award.

15. A game controller as claimed in claim 10 wherein the total award is modified by multiplication.

16. A game controller as claimed in claim 10 wherein the total award is modified by awarding a bonus prize as the modified total award.

17. A game controller as claimed in claim 10 arranged to determine a plurality of game outcomes such that the total award is determined from the plurality of game outcome.

18. A game controller as claimed in claim 10, arranged to modify the total award by:

awarding an entitlement to at least one further game outcome, determining a further total award from the at least one further game outcome;

modifying the further total award based on a size of the total award to obtain a further modified total award; and awarding the further modified total award.

19. A game controller as claimed in claim 10 arranged to determine that a player has an entitlement to the at least one game outcome prior to determining the at least one game outcome.

20. A game controller as claimed in claim 10, implemented, at least in part, by a processor executing program code stored in a memory.

21. A gaming system comprising:

a player interface comprising a display for displaying game outcomes to a player; and a game controller arranged to:

determine at least one game outcome for each of a plurality of games, the at least one game outcome being associated with a total award;

control the display to display the at least one game outcome;

determine a magnitude of the total award associated with the at least one game outcome;

modify the total award after play of each game based on the magnitude of the total award to obtain a modified total award, wherein the modified total award is modified by selecting one of a plurality of predefined multipliers to the total award, the multiplier to be applied selected based on the magnitude of the total award; and award the modified total award to the player, wherein the game controller comprises an award modification module arranged to modify the total award based on the magnitude of the total award to obtain a modified total award, and wherein the award modification module is arranged to modify the total award in accordance with a modification assigned to the range within which the total award falls, different modifications being to assigned to a plurality of ranges of total award amounts.

22. A gaming system as claimed in claim 21, wherein the game controller comprises an outcome determiner arranged to determine each game outcome.

23. A gaming system as claimed in claim 21, wherein the game controller comprises a total award module arrange to determine the total award from the at least one game outcome.

24. A gaming system as claimed in claim 21, wherein the award modification module is arranged to modify the total award based on a modification rule adapted to increase the volatility of the modified total award.

25. A gaming system as claimed in claim 21, wherein the award modification module is arranged to modify the total award based on a modification rule adapted to decrease the volatility of the modified total award.

26. A gaming system as claimed in claim 21 wherein the total award is modified by multiplication.

27. A gaming system as claimed in claim 21, wherein the total award is modified by awarding a bonus prize as the modified total award.

28. A gaming system as claimed in claim 21, wherein the game controller is arranged to determine a plurality of game outcomes such that the total award is determined from the plurality of game outcome.

29. A gaming system as claimed in claim 21, wherein the game controller is arranged to modify the total award by:

awarding an entitlement to at least one further game outcome, determining a further total award from the at least one further game outcome;

modifying the further total award based on a size of the total award to obtain a further modified total award; and awarding the further modified total award.

30. A gaming system as claimed in claim 21 arranged to determine that a player has an entitlement to the at least one game outcome prior to determining the at least one game outcome.

31. A gaming system as claimed in claim 21, wherein the game controller is implemented, at least in part, by a processor executing program code stored in a memory.

32. A tangible computer readable storage medium including computer program code which when executed by a processor implements a method of gaming, wherein a plurality of games is provided for play on a gaming machine, the method comprising:

determining at least one game outcome for each of the plurality of games, the at least one game outcome being associated with a total award;

determining a magnitude of the total award associated with the at least one game outcome;

modifying the total award after play of each game based on the magnitude of the total award to obtain a modified total award, wherein the modified total award is modified by selecting one of a plurality of predefined multipliers to the total award, the multiplier to be applied selected based on the magnitude of the total award; and awarding the modified total award, wherein modifying further comprises setting a plurality of ranges of total award sizes, assigning different modifications to each range, and modifying the total award in accordance with the modification assigned to the range within which the total award falls.

* * * * *